United States Patent [19]

Nemet-Mavrodin

[11] Patent Number: 4,918,256

[45] Date of Patent: Apr. 17, 1990

[54] CO-PRODUCTION OF AROMATICS AND OLEFINS FROM PARAFFINIC FEEDSTOCKS

[75] Inventor: Margaret Nemet-Mavrodin, Cherry Hill, N.J.

[73] Assignee: Mobil Oil Corporation, New York, N.Y.

[21] Appl. No.: 140,360

[22] Filed: Jan. 4, 1988

[51] Int. Cl.[4] ..... C07C 2/00

[52] U.S. Cl. ..... 585/415; 502/77

[58] Field of Search ..... 585/415, 407, 419; 502/707

[56] References Cited

U.S. PATENT DOCUMENTS

| | | | |
|---|---|---|---|
| 3,702,886 | 11/1972 | Argauer et al. | 423/328 |
| 3,709,979 | 1/1973 | Chu | 423/328 |
| 3,750,942 | 9/1973 | Cattanaih | 585/415 |
| 3,760,024 | 9/1973 | Cattanach | 260/673 |
| 3,941,871 | 3/1976 | Dwyer et al. | 423/326 |
| 3,972,832 | 8/1976 | Butter et al. | 252/437 |
| 4,304,686 | 12/1981 | Telford | 252/455 Z |
| 4,341,748 | 7/1982 | Plank et al. | 423/328 |
| 4,347,394 | 8/1982 | Detz et al. | 585/419 |
| 4,356,338 | 10/1982 | Young | 585/407 |
| 4,417,083 | 11/1983 | Bernard et al. | 585/419 |
| 4,579,988 | 4/1986 | Kieffer | 585/415 |
| 4,642,404 | 2/1987 | Shihabi | 585/415 |
| 4,665,251 | 5/1987 | Chu | 585/415 |
| 4,665,265 | 5/1987 | Chu et al. | 585/415 |
| 4,686,316 | 8/1987 | Morrison | 585/708 |
| 4,720,602 | 1/1988 | Chu | 585/415 |
| 4,724,270 | 4/1988 | Chang et al. | 585/415 |

FOREIGN PATENT DOCUMENTS

| | | |
|---|---|---|
| 0130013 | 1/1975 | European Pat. Off. . |
| 0014545 | 8/1980 | European Pat. Off. . |
| 0119023 | 9/1984 | European Pat. Off. . |
| 0150107 | 7/1985 | European Pat. Off. . |
| 0174121 | 3/1986 | European Pat. Off. . |

OTHER PUBLICATIONS

"Conversion of Pentane Into Aromatics Over ZSM-5 Zeolites", *ZEOLITES,* 1986, vol. 6, Jul.

WO 84/03879, 11 Oct. 1984, C01B, 33/28, U.S. translation.

*Primary Examiner*—Asok Pal

*Attorney, Agent, or Firm*—A. J. McKillop; C. J. Speciale; E. F. Kenehan, Jr.

[57] ABSTRACT

There is provided a process for converting a $C_5$-$C_{10}$ paraffinic feedstock such as a Udex reffinate into other hydrocarbons including $C_6$-$C_8$ aromatics, $C_2$-$C_4$ olefins, $C_9$+ aromatics and $C_1$-$C_3$ paraffins. By using a catalyst comprising (1) a binder and (2) ZSM-5 or ZSM-11, said catalyst having low acid catalytic activity as measured by an alpha value of 25 or less, the selectivity to the more desired $C_6$-$C_8$ aromatics and $C_2$-$C_4$ olefins is increased. The low alpha value of the catalyst may be achieved by deactivating the catalyst under conditions comprising steaming, high temperature calcining and/or coking.

18 Claims, No Drawings

CO-PRODUCTION OF AROMATICS AND OLEFINS FROM PARAFFINIC FEEDSTOCKS

BACKGROUND

This application relates to the co-production of aromatics, especially $C_6$-$C_8$ aromatics, and olefins, especially $C_2$-$C_4$ olefins, from paraffinic feedstocks (e.g., Udex raffinate) by converting said feedstocks over a catalyst of somewhat low activity, said catalyst comprising ZSM-5 or ZSM-11.

The Cattanach U.S. Pat. No. 3,756,942, the entire disclosure of which is expressly incorporated herein by reference, discloses a process for converting paraffinic feedstocks over zeolites such as ZSM-5 to produce a variety of hydrocarbon products. The underlying chemistry involved in this conversion is extremely complex. More particularly, a number of simultaneous and sometimes competing reactions take place to produce a variety of products which can, in turn, be reacted to form still different products. These possible reactions include cracking of paraffins, aromatization of olefins, and alkylation and dealkylation of aromatics. Products from the conversion of $C_5$+ paraffinic feedstocks over ZSM-5 include $C_6$-$C_8$ aromatics, $C_2$-$C_4$ olefins, $C_9$+ aromatics and $C_1$-$C_8$ paraffins. Of these products the $C_6$-$C_8$ aromatics and $C_2$-$C_4$ olefins are most desired.

$C_6$-$C_8$ aromatics, e.g. benzene, toluene, xylene and ethylbenzene, also known collectively as BTX, are valuable organic chemicals which can be used in a variety of ways. Since BTX has a high octane value it can be used as a blending stock for making high octane gasoline. By way of contrast, $C_9$+ aromatics (i.e. aromatic compounds having at least 9 carbon atoms) tend to have a relatively low octane value.

$C_2$-$C_4$ olefins, e.g., ethylene, propylene and butene, are also valuable organic chemicals which can be used to form polymers. By way of contrast, $C_1$-$C_3$ paraffins (i.e. methane, ethane and propane), particularly in admixture, are less valuable chemicals which are generally used for fuel.

The acid catalytic activity of aluminosilicate ZSM-5 is proportional to aluminum content in the framework of the zeolite. The more aluminum in the ZSM-5 framework, the greater the acid catalytic activity of the ZSM-5, particularly as measured by alpha value. Note the article by Haag et al, "The Active Site of Acidic Aluminosilicate Catalysts," *Nature,* Vol. 309, 14 June 1985, pp. 589–591, especially FIG. 2 on page 590 thereof. ZSM-5 with very little framework aluminum and correspondingly low acid catalytic activity can be prepared from reaction mixtures containing sources of silica and alumina, as well as various organic directing agents. For example, the Dwyer et al U.S. Pat. No. 3,941,871, the entire disclosure of which is expressly incorporated herein by reference, describes the preparation of ZSM-5 from a reaction mixture comprising silica, tetrapropylammonium ions and no intentionally added alumina. The alumina to silica molar ratio of the ZSM-5 produced by this method may be less than 0.005.

U.S. Pat. No. 4,341,748, the entire disclosure of which is expressly incorporated herein by reference, describes the preparation of ZSM-5 from reaction mixtures which are free of organic directing agents. However, the reaction mixture for making this organic-free form of ZSM-5 is restricted to silica to alumina molar ratios of 100 or less. Consequently, this organic-free synthesis tends to produce ZSM-5 having a relatively high acid catalytic activity (e.g., alpha value) in comparison with zeolites prepared by the method of the Dwyer et al U.S. Pat. No. 3,941,871.

In accordance with an aspect of the present invention, it has been discovered that the selectivity to more valuable $C_6$-$C_8$ aromatics and $C_2$-$C_4$ olefins can be increased by converting $C_5$+ paraffins over catalysts comprising ZSM-5, said catalysts having a relatively low alpha value.

SUMMARY

According to one aspect of this application there is provided a process for converting a hydrocarbon feedstock comprising at least 75 percent by weight of a mixture of at least two paraffins having from 5 to 10 carbon atoms, said process comprising contacting said hydrocarbon feedstock under sufficient conditions with a catalyst comprising (1) a binder and (2) ZSM-5 or ZSM-11, said ZSM-5 or ZSM-11 being an aluminosilicate zeolite, said catalyst having an alpha value from about 5 to about 25, whereby at least 10 percent by weight of said paraffins are converted to different hydrocarbons comprising at least 90 percent by weight of the sum of $C_6$-$C_8$ aromatics, $C_2$-$C_4$ olefins, $C_9$+ aromatics and $C_1$-$C_3$ paraffins.

According to another aspect of this application, there is provided a process for converting a hydrocarbon feedstock comprising at least 75 percent by weight of a mixture of at least two paraffins having from 5 to 10 carbon atoms said process comprising the steps of:

(i) contacting said hydrocarbon feedstock under sufficient conditions with a fluid bed of catalyst comprising (1) a binder and (2) ZSM-5 or ZSM-11, wherein said catalyst has an initial alpha value of at least about 50 prior to contact with said feedstock, whereby at least 90 percent by weight of said paraffins are converted to different hydrocarbons comprising at least 90 percent by weight of the sum of $C_6$-$C_8$ aromatics, $C_2$-$C_4$ olefins, $C_9$+ aromatics and $C_1$-$C_3$ paraffins, and whereby a hydrocarbonaceous deposit is formed on said catalyst;

(ii) separating catalyst of step (i) from hydrocarbons and recovering said $C_6$-$C_8$ aromatics and $C_2$-$C_4$ olefins;

(iii) removing said hydrocarbonaceous deposit from separated catalyst of step ii by contacting said separated catalyst with a gas comprising oxygen under conditions sufficient to oxidize said hydrocarbonaceous deposit; and (iv) recycling catalyst from step (iii) to said fluid bed of step (i), said process further comprising the steps of:

(v) adjusting the process parameters to cause partial deact of the catalyst introduced into the fluid bed of step (i), whereby it becomes necessary to reduce the WHSV by at least 50 percent in order to achieve the initial rate of conversion at constant conditions of temperature and pressure; and (vi) continuing the process, whereby the initial WHSV is reduced by at least 50 percent and the selectivity to the sum of $C_6$-$C_8$ aromatics and $C_2$-$C_4$ olefins is increased.

EMBODIMENTS

Although the term, zeolites, encompasses materials containing silica and alumina, it is recognized that the silica and alumina portions may be replaced in whole or in part with other oxides. More particularly, $GeO_2$ is an art recognized substitute for $SiO_2$. Also, $B_2O_3$, $Cr_2O_3$, $Fe_2O_3$, and $Ga_2O_3$ are art recognized replacements for $Al_2O_3$. Accordingly, the term zeolite as used herein shall connote not only materials containing silicon and, optionally, aluminum atoms in the crystalline lattice structure thereof, but also materials which contain suitable replacement atoms for such silicon and/or aluminum. On the other hand, the term aluminosilicate zeolite as used herein shall define zeolite materials consisting essentially of silicon and aluminum atoms in the crystalline lattice structure thereof, as opposed to materials which contain substantial amounts of suitable replacement atoms for such silicon and/or aluminum.

Particular zeolites which can be used in accordance with the present process for converting paraffins are ZSM-5 and ZSM-11. In addition to patents mentioned hereinabove, ZSM-5 is described in U.S. Pat. No. 3,702,886, the entire disclosure of which is expressly incorporated herein by reference. ZSM-11 is structurally similar to ZSM-5. In view of the structural similarities between ZSM-5 and ZSM-11, these two zeolites have been observed to have similar catalytic properties in the conversion of various hydrocarbons. ZSM-11 is described in U.S. Pat. No. 3,709,979, the entire disclosure of which is expressly incorporated herein by reference.

The original cations, e.g. alkali metal of zeolites discussed herein, can be replaced, at least in part, by ion exchange with other cations. Thus, the original cations are exchanged into a hydrogen or hydrogen ion precursor form or a form in which the original cation has been replaced by a metal of Groups IIA, IIIA, IVA, IB, IIB, IIIB, IVB, VIB or VIII of the Periodic Table. Thus, for example, the original cations can be exchanged with ammonium ions or with hydronium ions. Catalytically active forms of these would include, in particular, hydrogen, rare earth metals, aluminum, metals of Groups II and VIII of the Periodic Table and manganese.

Zeolites suitable for use in the present paraffin conversion process can be used either in the as-synthesized form, the alkali metal form and hydrogen form or another univalent or multivalent cationic form. These zeolites can also be used in intimate combination with a hydrogenating component such as tungsten, vanadium, molybdenum, rhenium, nickel, cobalt, chromium, manganese, or a noble metal such as platinum or palladium where a hydrogenation-dehydrogenation function is to be performed. Such components can be exchanged into the composition, impregnated therein or physically intimately admixed therewith. Such components can be impregnated in or on to a zeolite such as, for example, by, in the case of platinum, treating the zeolite with a platinum metal-containing ion. Suitable platinum compounds for this purpose include chloroplatinic acid, platinous chloride and various compounds containing the platinum amine complex. Combinations of metals and methods for their introduction can also be used.

Although the zeolites suitable for use in the process of the present invention may optionally include various elements ion exchanged, impregnated or otherwise deposited thereon, it is preferred to use zeolites in the hydrogen form, wherein the pore space of these zeolites is free of intentionally added elements other than hydrocarbonaceous deposits, particularly those elements which are incorporated into the zeolite pore space by an ion exchange or impregnation treatment. Thus, these zeolites can be free of oxides incorporated into the zeolites by an impregnation treatment. Examples of such impregnated oxides include oxides of phosphorus as well as those oxides of the metals of Groups IA, IIA, IIIA, IVA, VA, VIA, VIIA, VIIIA, IB, IIB, IIIB, IVB, or VB of the Periodic Chart of the elements (Fisher Soientic Company, Catalog No. 5-702-10). The impregnation of zeolites with such oxides is described in the Forbus et al U.S. Pat. No. 4,554,394, the entire disclosure of which is expressly incorporated herein by reference, particularly the passage thereof extending from column 8, line 42 to column 9, line 68. The hydrogen form of zeolites may be prepared by calcining the as-asythesized form of the zeolites under conditions sufficient to remove water and residue cf organic directing agents, if any, ion exchanging the calcined zeolites with ammonium ions and calcining the ammonium exchanged zeolites under conditions sufficient to evolve ammonia.

Synthetic ZSM-5 or ZSM-11, when employed as part of a catalyst in a hydrocarbon conversion process, should be dehydrated at least partially. This can be done by heating to a sufficient temperature, e.g. in the range of from about 65° C. to about 550° C. in an inert atmosphere, such as air, nitrogen, etc. and at atmospheric or subatmospheric pressures for between 1 and 48 hours. Dehydration can be performed at lower temperature merely by placing the zeolite in a vacuum, but a longer time is required to obtain a particular degree of dehydration. Organic materials, e.g. residues of organic directing agents, can be thermally decomposed in the newly synthesized zeolites by heating same at a sufficient temperature below the temperature at which the significant decomposition of the zeolite framework takes place, e.g., from about 200° C. to about 550° C., for a sufficient time, e.g. from 1 hour to about 48 hours.

Zeolites may be formed in a wide variety of particle sizes. Generally speaking, the particles can be in the form of a powder, a granule, or a molded product, such as extrudate having particle size sufficient to pass through a 2 mesh (Tyler) screen and be retained on a 400 mesh (Tyler) screen. In cases where the catalyst is molded, such as by extrusion, the crystalline material can be extruded before drying or dried or partially dried and then extruded.

In the case of the present catalysts, the zeolites are incorporated with another material resistant to the temperatures and other conditions employed in certain organic conversion processes. Such matrix or binder materials include active and inactive materials and synthetic or naturally occurring zeolites as well as inorganic materials such as clays, silica and/or metal oxides, e.g. alumina. The latter may be either naturally occurring or in the form of gelatinous precipitates, sols or gels including mixtures of silica and metal oxides. Use of a material in conjunction with a zeolite, i.e. combined therewith, which is active, may enhance the conversion and/or selectivity of the catalyst in certain organic conversion processes. Inactive materials suitably serve as diluents to control the amount of conversion in a given process so that products can be obtained economically and orderly without employing other means for controlling the rate of reaction. Frequently, crystalline silicate materials have been incorporated into naturally occurring clays, e.g. bentonite and kaolin. These materials, i.e. clays, oxides, etc., function, in part, as binders for the catalyst. It is desirable to provide a catalyst having good crush strength, because the catalyst may be subjected to rough handling, which tends to break the catalyst down into powder-like materials which cause problems in processing.

Naturally occurring clays which can be composited with zeolites include the montmorillonite and kaolin families which include the subbentonites, and the kaolins commonly known as Dixie, McNamee, Georgia and Florida clays, or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, zeolites can be composited with a porous matrix material such as silica-alumina, silica-magnesia, silica-zirconia, silica-thoria, silica-beryllia, silica-titania, as well as ternary compositions such as silica-alumina-thoria, silica-alumina-zirconia, silica-alumina-magnesia and silica-magnesia-zirconia. The matrix can be in the form of a cogel. A mixture of these components could also be used.

The catalyst used in the present paraffin conversion process may be in a variety of forms including in the form of extrudates or spray-dried microspheres. The Bowes U.S. Pat. No. 4,582,815, the entire disclosure of which is expressly incorporated herein by reference, describes a silica and ZSM-5 extrudate. The Chu et al U.S. Pat. No. 4,522,705 describes spray-dried microspheres containing alumina and ZSM-5. This form of microspheres, as opposed to extrudates, is preferred when the catalyst is to be contacted with the hydrocarbon feedstock in a fluid bed reactor.

Hydrocarbon feedstocks which can be converted according to the present process include various refinery streams including coker gasoline, light F.C.C. gasoline, as well as $C_5$ to $C_7$ fractions of straight run naphthas and pyrolysis gasoline. Particular hydrocarbon feedstocks are raffinates from a hydrocarbon mixture which has had aromatics removed by a solvent extraction treatment. Examples of such solvent extraction treatments are described on pages 706–709 of the *Kirk-Othmer Encyclopedia of Chemical Technology,* Third Edition, Vol. 9, John Wiley and Sons, 1980. A particular hydrocarbon feedstock derived from such a solvent extraction treatment is a Udex raffinate. The paraffinic hydrocarbon feedstock suitable for use in the present process may comprise at least 75 percent by weight, e.g., at least 85 percent by weight, of paraffins having from 5 to 10 carbon atoms.

The paraffinic hydrocarbons may be converted under sufficient conditions including, e.g., a temperature of from about 100° C. to about 700° C., a pressure of from about 0.1 atmosphere to about 60 atmospheres, a weight-hourly space velocity of from about 0.5 to about 400 and a hydrogen/hydrocarbon mole ratio of from about 0 to about 20. Suitable reaction conditions are also described in the aforementioned Cattanach U.S. Pat. No. 3,756,942.

The catalyst used in the present paraffin conversion process may have a relatively low acid catalytic activity for a catalyst comprising ZSM-5 or ZSM-11. More particularly, these catalysts may have an alpha value of from about 5 to about 25, e.g., from about 5 to about 20, e.g., from about 10 to about 15. When alpha value is referred to herein, it is noted that the alpha value is an approximate indication of the catalytic cracking activity of the catalyst compared to a standard catalyst and it gives the relative rate constant (rate of normal hexane conversion per volume of catalyst per unit time). It is based on the activity of the highly active silica-alumina cracking catalyst taken as an alpha of 1 (Rate Constant=0.016 $sec^{-1}$). Alpha tests are described in U.S. Pat. No. 3,354,078 and in *The Journal of Catalysis,* Vol. IV, pp. 522–529 (August 1965), each incorporated herein by reference as to that description. Alpha tests are also described in *J. Catalysis,* 6, 278 (1966) and *J. Catalysis,* 61, 395 (1980), each also incorporated herein by reference as to that description.

In accordance with the present process, the present hydrocarbon feedstock is converted under sufficient conditions to convert at least 90 percent by weight (e.g., at least 93 percent by weight of the paraffins present into different hydrocarbons. These different hydrocarbons may comprise at least 90 percent by weight (e.g., at least 95 percent by weight) of the sum of $C_6$-$C_8$ aromatics, $C_2$-$C_4$ olefins, $C_9$+ aromatics and $C_1$-$C_3$ paraffins. The conversion of paraffins may be less than 100 percent, e.g., 99 percent by weight or less. Conversion of paraffins under excessively extreme conditions may cause excessive coke formation on the catalyst and may result in the further conversion of $C_2$-$C_4$ olefins and $C_6$-$C_8$ aromatics into less desired products. The conversion products may include at least 68 percent by weight of the sum of $C_6$-$C_8$ aromatics plus $C_2$-$C_4$ olefins.

The catalyst suitable for use in accordance with the present invention may have an alpha value of from about 5 to about 20 or 25, e.g. from about 10 to about 15. This low alpha value may be achieved in a variety of ways. For example, the active zeolite portion of the catalyst could be blended with sufficient amounts of inert binder material. Thus, the ratio of binder to zeolite may be at least 70:30, e.g., at least 95:5. Another way of achieving an alpha value of 25 or less, is to subject a more active catalyst, e.g., having an alpha value of at least 50 in the catalytically activated form, to sufficient deactivating conditions. Examples of such deactivating conditions include steaming the catalyst, coking the catalyst and high temperature calcination of the catalyst, e.g., at a temperature of greater than 700° C. It may also be possible to partially deactivate the catalyst by subjecting the catalyst to a sufficient amount of a suitable catalyst poison. Catalysts which have been deactivated in the course of organic compound conversions, particularly where the catalyst has been subjected to conditions of high temperature, coking and/or steaming, may be useful. Examples of such organic compound conversions include the present conversion of $C_5$-$C_{10}$ paraffins and the conversion of methanol into hydrocarbons.

It may also be possible to use zeolites which are intrinsically less active by virtue of having a high silica to alumina molar ratio of, e.g., greater than 100. However, since ZSM-5 may be more difficult to prepare at such higher silica to alumina ratios, particularly in the absence of an organic directing agent, it may be more desirable to use a more active form of ZSM-5, e.g., having a silica to alumina molar ratio of 100 or less. Even though the alpha value of the activated form of such ZSM-5 may be rather high, the alpha value of the bound catalyst may be made much lower by one or more of the above-mentioned techniques. For example, ZSM-5 prepared from a reaction mixture not having an organic directing agent and having a framework silica to alumina molar ratio of about 70:1 or less, may be bound with an inert binder at a binder:ZSM-5 weight ratio of 75:25, and the bound catalyst could he subjected to sufficient deactivating conditions involving high temperature calcination and/or steaming of the catalyst.

The catalyst suitable for use in accordance with the present invention may be free of intentionally added gallium. More particularly, the only gallium in the catalyst may result from unavoidable trace gallium impurities either in the binder or in the sources of silica and alumina used to prepare the zeolite.

The paraffin conversion process of the present invention may take place either in a fixed bed or a fluid bed of catalyst particles. Particularly, when a fluid bed process is used, the process parameters may be adjusted to cause partial deactivation of the catalyst, thereby enabling the increase in selectivity to $C_6$-$C_8$ aromatics and $C_2$-$C_4$ olefins. In such a fluid bed process, the paraffinic feedstock is contacted with a fluid bed of catalyst, whereby conversion products are generated. Lighter hydrocarbons can be separated from the catalyst by conventional techniques such as cyclone separation and, possibly, steam stripping. However, the dense hydrocarbonaceous deposit e.g., coke which forms on the catalyst is more difficult to remove. This hydrocarbonaceous deposit may be removed by transporting the catalyst to a separate regenerator reactor, wherein the hydrocarbonaceous deposit is burned off the catalyst. The regenerated catalyst may then be returned to the fluid bed reactor for further contact with the paraffinic feedstock.

It is quite apparent from this process that the catalyst is constantly subjected to conditions which tend to deactivate the catalyst. These conditions include steaming, high temperatures and coking. Normally, the operator of such a process would tend to minimize the rate of catalyst deactivation by controlling parameters such as the amount and temperature of steam in the striping section, the residence time of the catalyst in the various stages, the rate of catalyst recycle and the temperature in the regenerator. Some deactivation of the catalyst is inevitable, but the activity of the overall catalyst inventory may be maintained near its original level by periodically removing aged catalyst from the system and by replacing this aged catalyst with fresh catalyst. However, in view of the present discovery of improved product selectivity as a result of using deactivated catalyst, the process operator may now be motivated to use the process parameters at his disposal to maximize rather than minimize catalyst aging while at the same time refraining from replacing aged catalyst with fresh catalyst at a rapid rate. In such a process, the operator could monitor the rate of catalyst deactivation by reducing the weight hourly space velocity (WHSV) of the feed, while maintaining a constant rate of conversion under otherwise constant conditions. As activity of the catalyst decreases the operator would also observe an improved selectivity to $C_6$-$C_8$ aromatics and $C_2$-$C_4$ olefins.

EXAMPLE 1

The catalyst used in this Example was the hydrogen form of aluminosilicate ZSM-5 bound in a mixture of silica and naturally occurring clay containing 25 percent by weight ZSM-5 and 75 percent by weight binder. This catalyst had an initial alpha value of about 76. The silica to alumina molar ratio of the ZSM-5 was about 50.

10 grams of this ZSM-5 catalyst were calcined in air at 850° C. and atmospheric pressure for 30 min. Temperature was then reduced to 800° C., and the catalyst was held at this temperature for an additional 1.5 hours until it reached an alpha of 14. Its ability to upgrade a complex mixture of paraffinic hydrocarbons was then measured in an atmospheric pressure microreactor. The mixture of paraffinic hydrocarbons was a Udex raffinate having the composition given in Table 1.

TABLE 1

| UDEX Raffinate Composition | |
|---|---|
| Component | Wt. % |
| $C_4$ paraffins | 0.09 |
| $C_5$ paraffins | 3.87 |
| $C_5$ olefins and naphthenes | 0.87 |
| $C_6$ paraffins | 51.44 |
| $C_6$ olefins and naphthenes | 3.06 |
| $C_7$ paraffins | 32.33 |
| $C_7$ olefins and naphthenes | 0.31 |
| $C_8$+ PON | 3.80 |
| Benzene | 0.16 |
| Toluene | 3.98 |
| Xylenes | 0.09 |
| Other Properties | |
| Specific gravity | 0.674 |
| Clear (R + O) octane number | 66.5 |

Results of this conversion are given as follows:

| | | |
|---|---|---|
| Temp., °C. | 650 | 650 |
| WHSV | 0.56 | 0.56 |
| Time-on-stream, hrs | 3.3 | 19.6 |
| Conv. of paraffins, % | 96.8 | 93.4 |
| Selectivity, wt. % | | |
| $C_6$-$C_8$ aromatics | 33.4 | 34.2 |
| $C_2$-$C_4$ olefins | 34.5 | 35.2 |
| $C_9$+ aromatics | 1.7 | 1.6 |
| $C_1$-$C_3$ paraffins | 27 | 25.1 |

EXAMPLE 2

10 grams of the ZSM-5 catalyst described in Example 1 were steamed in an air-steam mixture (35 volume percent steam) at 580° C. and atmospheric pressure for 6 hours. The steaming procedure reduced the alpha value of the catalyst to about 20. The steamed catalyst was then tested at 650° C. and 0.32 WMSV. Results of this conversion are shown below.

| | | |
|---|---|---|
| Time-on stream, hours | 2.5 | 8.5 |
| Paraffin conversion, % | 93.5 | 93.2 |
| Selectivity, wt. % | | |
| $C_6$-$C_8$ aromatics | 26.9 | 30.4 |
| $C_2$-$C_4$ olefins | 41.3 | 39.8 |
| $C_9$+ aromatics | 3 | 2.9 |
| $C_1$-$C_3$ paraffins | 25.2 | 26 |

EXAMPLE 3

10 grams of the ZSM-5 catalyst described in Example 1 were contacted with raffinate at 650° C., atmospheric pressure and 0.67 WHSV until the conversion of paraffins decreased to less that 95 percent. The coked catalyst converted the feed as follows:

| | |
|---|---|
| Paraffin conversion, % | 91 |
| Selectivity, wt. % | |
| $C_6$-$C_8$ aromatics | 41.8 |
| $C_2$-$C_4$ olefins | 26.7 |
| $C_9$+ aromatics | 4.3 |
| $C_1$-$C_3$ paraffins | 26.2 |

COMPARATIVE EXAMPLE 10 grams of the ZSM-5 catalyst described in Example 1, without further treatment to reduce the alpha value thereof, were tested as in Example 1. Results of this conversion are given as follows:

| | |
|---|---|
| Temp., °C. | 650 |
| WHSV | 2.6 |
| Conv. of paraffins, % | 98.2 |
| Selectivity, wt. % | |
| $C_6$–$C_8$ aromatics | 38.9 |
| $C_2$–$C_4$ olefins | 10.5 |
| $C_9$+ aromatics | 11.2 |
| $C_1$–$C_3$ paraffins | 35.4 |

What is claimed is:

1. A process for converting a hydrocarbon feedstock comprising at least 75 percent by weight of a mixture of at least two paraffins having from 5 to 10 carbon atoms, said process comprising contacting said hydrocarbon feedstock under sufficient condition with a catalyst comprising (1) a binder and (2) ZSM-5 or ZSM-11, said ZSM-5 or ZSM-11 being an aluminosilicate zeolite, said catalyst having an alpha value from about 5 to about 25, whereby at least 90 percent by weight of said paraffins are converted to different hydrocarbons comprising at least 90 percent by weight of the sum of $C_6$-$C_8$ aromatics, $C_2$-$C_4$ olefins, $C_9$+ aromatics and $C_1$-$C_3$ paraffins, wherein the activated form of the fresh catalyst as initially prepared has an alpha value of at least 50 and the fresh catalyst is partially deactivated by subjecting the fresh catalyst to sufficient deactivating conditions to achieve an alpha value of from about 5 to about 25, and wherein said zeolite is in the hydrogen form and said zeolite is free of oxides impregnated thereon.

2. A process according to claim 1, wherein the fresh catalyst is partially deactivated by subjecting the fresh catalyst to sufficient deactivating conditions to achieve an alpha value of less than 20 for said catalyst.

3. A process according to claim 1, wherein the fresh catalyst is partially deactivated by a treatment selected from the group consisting of steaming the catalyst, coking the catalyst, calcining the catalyst at a temperature of greater than 700° C., and combinations of said steaming, coking and calcining.

4. A process according to claim 1, wherein said catalyst is free of intentionally added gallium.

5. A process according to claim 1, wherein said catalyst is prepared by combining a binder material consisting essentially of alumina or silica in combination with alumina with a ZSM-5 aluminosilicate zeolite having a silica to alumina ratio of 100 or less.

6. A process according to claim 5, wherein said ZSM-5 is prepared from an aqueous reaction mixture comprising sources of silica and alumina, said reaction mixture being free of an organic directing agent.

7. A process according to claim 1, wherein said catalyst has an alpha value of from about 10 to about 15.

8. A process according to claim 1, wherein the weight ratio of binder to ZSM-5 is at least 70:30.

9. A process according to claim 6, wherein the weight ratio of binder to ZSM-5 is at least 95:5.

10. A process according to claim 1, wherein said hydrocarbon feedstock is selected from the group consisting of coker gasoline, F.C.C. gasoline, $C_5$ to $C_7$ fractions of straight run naphthas, pyrolysis gasoline and combinations thereof.

11. A process according to claim 1, wherein said hydrocarbon feedstock is a raffinate from a hydrocarbon mixture which has had aromatics removed by a solvent extraction treatment.

12. A process according to claim 11, wherein said hydrocarbon feedstock is a Udex raffinate.

13. A process according to claim 1, wherein said hydrocarbon feedstock is contacted with a fluid bed of said catalyst.

14. A process according to claim 1, wherein the reaction conditions include a temperature of from about 100° C. to about 700° C., a pressure of from about 0.1 atmosphere to about 60 atmospheres, a weight hourly space velocity of from about 0.5 to about 400 and a hydrogen/hydrocarbon mole ratio of from about 0 to about 20.

15. A process according to claim 1, wherein less than 100 percent of said paraffins are converted.

16. A process according to claim 1, wherein said catalyst comprises ZSM-5.

17. A process according to claim 1, wherein said different hydrocarbons comprise at least 68 percent by weight of the sum of $C_6$-$C_8$ aromatics and $C_2$-$C_4$ olefins.

18. A process according to claim 1, wherein said catalyst has an alpha value of about 20 or less.

* * * * *